US006217423B1

(12) United States Patent
Ohmori et al.

(10) Patent No.: US 6,217,423 B1
(45) Date of Patent: Apr. 17, 2001

(54) APPARATUS AND METHOD FOR MIRROR SURFACE GRINDING OF MAGNETIC DISC SUBSTRATE

(75) Inventors: Hitoshi Ohmori, Wako; Nobuhide Itoh, Hitachi; Junichi Uchino, Tokyo; Susumu Shimizu, Tokyo; Shinji Ishii, Tokyo; Manabu Yamada, Tokyo, all of (JP)

(73) Assignees: The Institute of Physical and Chemical Research, Saitama; Japan Tobacco Inc., Tokyo, both of (JP)

( * ) Notice: Subject to any disclaimer, the term of this patent is extended or adjusted under 35 U.S.C. 154(b) by 0 days.

(21) Appl. No.: 09/310,208

(22) Filed: May 12, 1999

(30) Foreign Application Priority Data

May 19, 1998 (JP) ..... 10-136198

(51) Int. Cl.[7] ..... B24B 7/30

(52) U.S. Cl. ..... 451/63; 451/262; 451/267; 451/905

(58) Field of Search ..... 451/63, 262, 267, 451/268, 905, 908

(56) References Cited

U.S. PATENT DOCUMENTS 4,007,560 * 2/1977 Janssen .
5,109,631 * 5/1992 Biebesheimer et al. .
5,119,595 * 6/1992 Ushiyama et al. .
5,562,529 * 10/1996 Kishii et al. .
5,910,040 * 6/1999 Moriyasu et al. .
5,975,997 * 11/1999 Minami .
5,989,108 * 11/1999 Ikeda et al. .

* cited by examiner

*Primary Examiner*—Timothy V. Eley
*Assistant Examiner*—Willie Berry, Jr.
(74) *Attorney, Agent, or Firm*—Griffin & Szipl, P.C.

(57) ABSTRACT

A metal bond grinding wheel 12 having a horizontal working surface 12*a,* a holding and rotating means 14 for a workpiece having a horizontal supporting surface 14*a* opposite to said working surface 12*a,* a voltage applying means 16 having the metal bond grinding wheels and an electrode 16*a* installed oppositely to the working surfaces in an uncontacted state and applying a pulsed voltage between them, a grinding fluid feeding means 18 for feeding an electroconductive grinding fluid to the working surfaces are installed. The holding and rotating means 14 holds and rotate a disk-like magnetic disc substrate 1 or a truing grinding wheel 2 to closely contact to its supporting surface, has constitution capable of moving horizontally and vertically, wherein a surface for working 12*a* is processed to yield a flat surface on the machine, subsequently, alternative operations on the machine are carried out for grinding of the supporting surface 14*a* of the holding and rotating means of the workpiece simultaneously with electrolytic dressing of the metal bond grinding wheel and grinding of the magnetic disc substrate 1 attached to the holding and rotating means of the workpiece.

4 Claims, 4 Drawing Sheets

APPARATUS AND METHOD FOR MIRROR SURFACE GRINDING OF MAGNETIC DISC SUBSTRATE

BACKGROUND OF THE INVENTION (i) Technical Field of the Invention

The present invention relates to an apparatus and a method for the mirror surface grinding of a magnetic disc substrate for a hard disk.

(ii) Description of the Related Art

A hard disk for a computer is a magnetic disk prepared by applying a magnetic substance to the surface (one side or both sides) of a disk-like substrate (e.g., made of aluminum), and reads information by rotating it at a high speed (e.g., 10000 rpm or faster) and moving a head along the magnetic surface.

The degree of parallelism (precision of the thickness) and the surface coarseness of substrate for a hard disk (hereafter, magnetic disk substrate) requires high precision to record information in a high density. For example, small magnetic disk substrates of a diameter of 2.5 inches (ca. 64 mm) and a diameter of 3.5 inches (ca. 95 mm) have a maximum acceptable range (difference between maximum and minimum thickness), for example, of 3 $\mu$m and 7 $\mu$m, respectively.

Conventionally for processing magnetic disk substrates of such high precision, a flatbed lap has been mainly used. The flatbed lap is a lap for simultaneous lapping both sides and has, for example, gear teeth surrounding a part for fitting a workpiece; the fitting part rotates by itself meshing with the central and surrounding gears, pressure is applied by an upper cylinder, and a free abrasive is put between a lap tool (or lapping machine) and the workpiece is processed by relative movement of the lap and the workpiece.

The aforementioned conventional lapping machine (e.g., a flatbed lap) is characterized by possible high processing precision by using relatively simple facilities. On the contrary, there are following problems.

(1) The conventional lap, when applied to processing using a free abrasive, results in a very low processing rate (1/10 or lower grinding rate) and is time consuming for processing. Therefore, a facility of a large size is normally used for simultaneous processing of a plurality of magnetic disk substrates. Notwithstanding this, the processing time required for a disk is longer.

(2) A standard lap is previously processed in high precision to process a workpiece to fit to the lap. Therefore, maintaining the precision of the lap itself, which is lowered by abrasion, etc. requires repeated processing of the lap. Normally in this case, "lapping adjustment" of the upper and lower laps is carried out for lapping the respective laps. By this step, uneven surfaces become even. However, the right angle against the rotational shaft cannot be kept constant, which lowers the degree of parallelism of the workpiece after processing. This means that constant pressure lapping allows truing (lapping adjustment) on a lapping machine; however, it does not allow readjustment of the degree of parallelism of a jig for holding the workpiece to a grinding wheel even if the flatness of the grinding wheel (the lap) has been improved. Therefore, the degree of parallelism (precision of thickness) of both sides of the workpiece cannot be improved by the adjustment.

In addition, very recently, crashing of hard disks, particularly of motors has very frequently occurred. One of the causes of disk crashing is an unbalanced thickness of a magnetic disc substrate. There is a problem that the unbalanced thickness of a magnetic disc substrate causes a decentering force which lowers the life of the bearings of the motor, finally resulting in crash of the motor in a short time. Thus, in order to increase the reliability of the hard disk, increasing the degree of parallelism (precision of thickness) of the magnetic disc substrate is required more than with conventional substrates. However, the conventional lap aforementioned does not achieve this object due to the requirement of a longer processing time that is not practical.

SUMMARY OF THE INVENTION

The present invention has been created to solve such problems. The purpose of the present invention is to provide an apparatus and a method for mirror surface grinding of a magnetic disc substrate capable of largely improving the processing rate of the magnetic disc substrate in comparison with the conventional lapping machine and of improving the degree of parallelism (precision of thickness) of both sides of the substrate and the surface coarseness in comparison with the conventional apparatus and method. According to a first aspect of the present invention, there is provided an apparatus for the mirror surface grinding of a magnetic disc substrate which comprises a metal bond grinding wheel (12) rotating around a vertical shaft center Z1 and having a horizontal working surface **(12*a*); a workpiece holding and rotating means (14) having a horizontal supporting surface (14*a*) opposite to said working surface and rotating around a vertical shaft center Z2; a voltage applying means (16) having said metal bond grinding wheel as a positive electrode and an electrode (16*a*) as a negative electrode installed oppositely to said working surface of the metal bond grinding wheel in an uncontacted state and applying a pulsed voltage between both the electrodes; and a grinding fluid feeding means (18) for feeding an electroconductive grinding fluid to the working surface of said metal bond grinding wheel, wherein said workpiece holding and rotating means (14) holds and rotates a disk-like magnetic disc substrate (1) or a disk-like truing grinding wheel (2) so as to closely contact its supporting surface, and is horizontally and vertically movably constituted, whereby (A) the working surface (12*a*) of the metal bond grinding wheel is subjected to flat grinding on the machine, and while the metal bond grinding wheel is then subjected to electrolytic dressing, simultaneously, (B) the grinding of the supporting surface (14*a*) of the workpiece holding and rotating means, and (C) the grinding of the magnetic disc substrate (1)** attached to the workpiece holding and rotating means are carried out on the machine.

According to the second aspect of the present invention, there is provided a method for mirror surface grinding of a magnetic disc substrate which uses a metal bond grinding wheel (12) rotating around a vertical shaft center Z1 and having a horizontal working surface **(12*a*), and a workpiece holding and rotating means (14) having a horizontal holding surface (14*a*) opposite to said working surface and rotating around a vertical shaft center Z2, said method comprising (A) horizontally moving a workpiece holding and rotating means to subject the working surface (12*a*) of the metal bond grinding wheel to horizontal flat grinding on the machine by a truing grinding wheel attached thereto, subsequently, applying a pulsed voltage between a metal bond grinding wheel as a positive electrode and an electrode (16*a*) as a negative electrode installed oppositely to said working surface of the metal bond grinding wheel in an uncontacted state, and simultaneously feeding an electroconductive grinding fluid between them, and subjecting the metal bond grinding wheel to electrolytic dressing, and simultaneously, alternatively carrying out, on the machine, (B) a supporting surface grinding step for grinding the supporting surface (14***a*) of the workpiece holding and rotating means by using the metal bond grinding wheel, and (C) a workpiece grinding step for grinding a magnetic disc substrate (1) attached to the workpiece holding and rotating means by using the metal bond grinding wheel.

According to the apparatus and the method of the present invention, (A) the working surface (12*a*) of the metal bond grinding wheel can be ground to make a horizontal flat surface on the machine by horizontally moving the workpiece holding and rotating means (14) to which a truing grinding wheel (2) is attached. Thus, even if the precision of flatness of the working surface has been lowered by abrasion, etc., truing can be operated on the machine to maintain the right angle with respect to the rotational axis. This means that, different from the constant pressure lapping, on-machine truing allows not only maintaining the degree of flatness of the working surface of the grinding wheel, but also the right angle with respect to the rotational axis Z1 of the working surface(12*a*) of the grinding wheel.

The supporting surface(14*a*) of the workpiece holding and rotating means can be ground by horizontally moving the workpiece holding and rotating means (14) rotating on the machine. Thus, this step allows keeping the degree of flatness of the supporting surface (14*a*) and the right angle with respect to the rotational axis Z2, and therefore, keeping parallel the supporting surface (14*a*) and the working surface(12*a*) of the grinding wheel.

Holding the magnetic disc substrate (1) in contact with the supporting surface (14*a*) of the workpiece holding and rotating means (14) and moving horizontally allows grinding the opposite side (under surface) of the substrate (1) on the working surface (12*a*) of the grinding wheel. Thus, the degree of parallelism (precision of thickness) of both surfaces of the magnetic disc substrate (1) can be maintained.

Both the grinding step of the supporting surface and the grinding step of the workpiece are carried out by the voltage applying means (16) and the grinding fluid feeding means (18) with electrolytic dressing of the metal bond grinding wheel. Thus, a large increase in processing rate of the magnetic disc substrate is achieved in comparison with the conventional lapping machine and an improved mirror surface of both surfaces is also achieved in contrast to the conventional methods.

According to a third aspect of the present invention, there is provided an apparatus for mirror surface grinding of a magnetic disc substrate which comprises upper and lower metal bond grinding wheels (22, 23) having mutually opposing working surfaces (22*a*, 23*a*), wherein the wheels rotate around vertical central shafts Z3, Z4, respectively; a voltage applying means (16) having the upper and lower metal bond grinding wheels as positive electrodes and an electrode (16*a*) as a negative electrode installed oppositely to the upper and lower working surfaces of the metal bond grinding wheel in an uncontacted state and applying a pulsed voltage between both the electrodes; a grinding fluid feeding means (18) for feeding an electroconductive grinding fluid to said working surfaces; a workpiece holding and rotating means (24) for holding the magnetic disc substrate (1) between the upper and lower metal bond grinding wheels and for horizontally shaking the substrate (1) while the substrate (1) is rotated around the vertical axis; either of said upper or lower metal bond grinding wheels being horizontally and vertically movably installed;

whereby (A) the working surfaces (22*a*, 23*a*) of the upper and lower metal bond grinding wheels (22, 23) are subjected to horizontal flat grinding on the machine; and there are then alternately carried out on the machine (B) a carrier grinding step for simultaneously grinding, on the machine, both the surfaces of a carrier (24*a*) of the workpiece holding and rotating means (24) held between the upper and lower metal bond grinding wheels while these wheels are subjected to electrolytic dressing by using an electrode (16*a*) as a negative electrode, and (C) a workpiece grinding step for simultaneously grinding, on the machine, both the surfaces of the magnetic disc substrate (1) held between the upper and lower metal bond grinding wheels while these wheels are subjected to electrolytic dressing by using said carrier (24*a*) as a negative electrode.

According to the fourth aspect of the present invention, there is provided a method for mirror surface grinding of a magnetic disc substrate which uses upper and lower metal bond grinding wheels (22, 23) having mutually opposing working surfaces (22*a*, 23*a*) and rotating around vertical central shafts Z3, Z4, respectively, and a workpiece holding and rotating means (24) for holding a magnetic disc substrate (1) between the upper and lower metal bond grinding wheels and for horizontally shaking the substrate (1) while the substrate (1) is rotated around the vertical axis, said method comprising (A) relatively horizontally moving the upper and lower metal bond grinding wheels (22, 23) on the machine to mutually closely contact these wheels (22, 23), whereby the respective working surfaces (22*a*, 23*a*) are subjected to horizontal flat grinding, and, subsequently, alternatively carrying out, on the machine, (B) a carrier grinding step of applying a pulsed voltage between the upper and lower metal bond grinding wheels as a positive electrode and an electrode (16*a*) as a negative electrode installed oppositely to the upper working surface and lower working surface of the grinding wheels in an uncontacted state, and, simultaneously, feeding an electroconductive grinding fluid between them, subjecting the upper and lower metal bond grinding wheels to electrolytic dressing, and simultaneously therewith, simultaneously grounding, on the machine, both the surfaces of a carrier (24*a*) of the workpiece holding and rotating means (24) held therebetween by the upper and lower metal bond grinding wheels, and (C) a workpiece grinding step of subjecting the upper and lower metal bond grinding wheels to electrolytic dressing by the use of said carrier (24*a*) as a negative electrode, and simultaneously therewith, simultaneously grinding on the machine both the surfaces of the magnetic disc substrate (1) held between the upper and lower metal bond grinding wheels by using the upper and lower metal bond grinding wheels.

According to said apparatus and method of the present invention, (A) the upper and lower metal bond grinding wheels (22 and 23) are relatively horizontally moved to contact closely on the machine. In this way, respective working surfaces (22*a* and 23*a*) are subjected to horizontal flat grinding. Therefore, even if the precision of flatness of the working surface is lowered by abrasion, etc., truing on the machine is possible, not only of the flatness of the working surface of the grinding wheel, but also of the degree of squareness against the rotation axis, and the degree of parallelism of the upper and lower working surfaces (22*a* and 23*a*) can be maintained with high precision.

Furthermore, (B) both the surfaces of the carrier (24*a*) of the workpiece holding and rotating means (24) are simultaneously ground on the machine with electrolytic dressing of the upper and lower metal bond grinding wheels using the upper and lower metal bond grinding wheels as a positive electrode. Thus, the degree of parallelism (precision of thickness) of both surfaces of the carrier (24*a*) is maintained with high precision and surface coarseness thereof can be maintained to a mirror surface more improved than a conventional one.

Grinding is carried out for both the surfaces of the magnetic disc substrate (1) held between the upper and lower metal bond grinding wheels with electrolytic dressing of the upper and lower metal bond grinding wheels, using said carrier (24*a*) as a negative electrode on the machine. Thus, electrolytic distribution between the carrier (24*a*) and the metal bond grinding wheel can be made even with high precision. Both the surfaces of the magnetic disc substrate (1) are ground and processed with electrolytic dressing with high precision and evenly to make possible a high degree of parallelism (precision of thickness) with high precision and make possible a surface coarseness corresponding to a mirror surface much improved over that obtainable from conventional methods.

Other purposes and beneficial characteristics of the present invention will become known from the following description with reference to drawings.

DETAILED DESCRIPTION OF THE PREFERRED EMBODIMENT

The preferred embodiment of the present invention will be described with reference to the drawings. The same symbols are given to common parts in respective figures to omit a duplicate description.

The inventors of the present invention created "a method and an apparatus for electrolytic dressing of an electroconductive grinding wheel" named (electrolytic in-process dressing: ELID grinding method) (Patent Gazette 1994-075823). According to this method and apparatus, a voltage is applied to the electroconductive grinding wheel and the electroconductive grinding wheel is subjected to electrolytic dressing to yield a good mirror surface and smooth flat surface with high efficiency and at a high rate.

The ELID grinding method does not cause clogging of the grinding wheel by electrolytic dressing. Fine grains yield a very excellent processed surface like a mirror surface by the grinding process. Furthermore, mirror surface grinding can be operated at a rate some ten times greater than lapping, etc., in which free abrasive is used. The present invention has further developed the ELID grinding method to achieve even higher precision.

Figure 1:
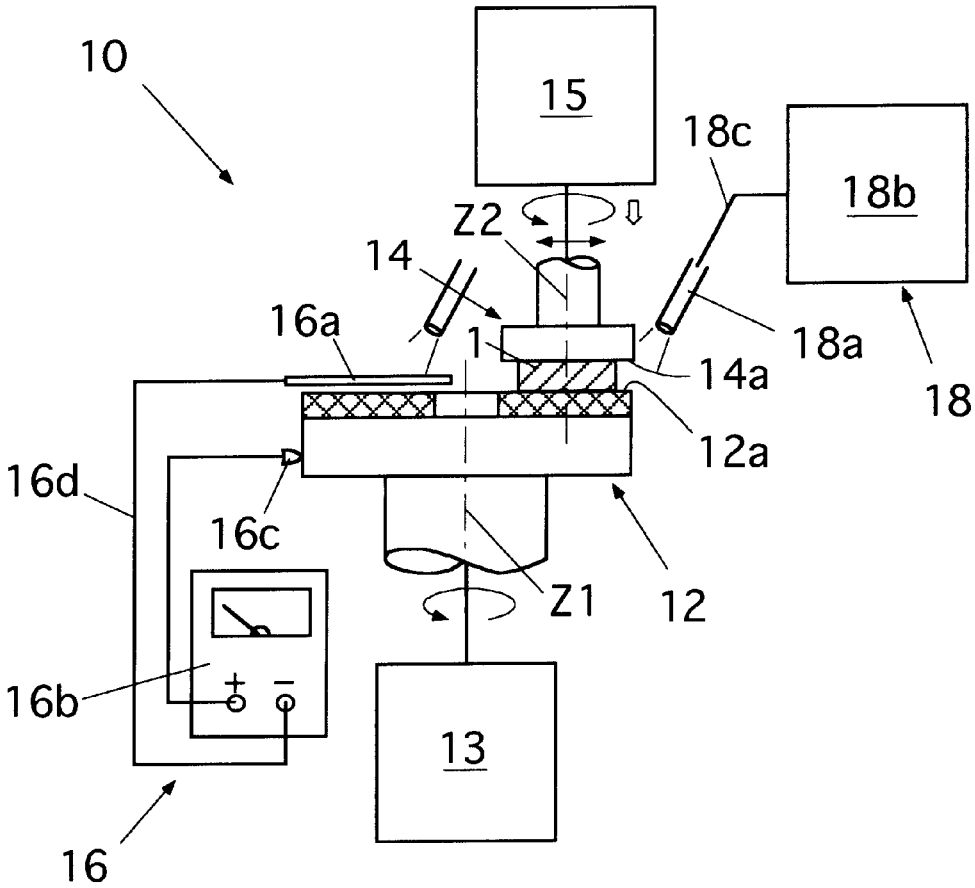
FIG. 1 is a general diagrammatic view showing the first embodiment for carrying out an apparatus for mirror surface grinding of a magnetic disc substrate, according to the present invention.

FIG. 1 is a general diagrammatic view showing the first embodiment of an apparatus for mirror surface grinding of a magnetic disc substrate, according to the present invention. As shown in the figure, mirror surface grinding apparatus 10 of the present invention comprises a metal bond grinding wheel 12 having a horizontal working surface 12*a*, a workpiece holding and rotating means 14 having a horizontal working surface 14*a* opposite to the working surface 12*a* of the metal bond grinding wheel 12, a voltage applying means 16, and a grinding fluid feeding means 18. For reference to the following description, the magnetic disc substrate 1 is a thin disk comprising aluminum or glass.

The metal bond grinding wheel 12 is rotatively driven by a central vertical shaft Z1 by an actuator 13. The metal bond grinding wheel 12 has cerium oxide grains or CBN grains and a binder comprising cast iron and cobalt, and allows "electrolytic dressing" to expose grains by electrolysis of the binder.

The workpiece holding and rotating means 14 is also rotatively driven by a central vertical shaft Z2, installed highly precisely parallel to the vertical shaft center Z1 of the metal bond grinding wheel 12, by means of another actuator 15. The workpiece holding and rotating means 14 is also held and rotated by closely contacting a disk-like member, namely, the magnetic disc substrate 1 as a working object or a truing grinding wheel 2 (mentioned later) with the same shape as substrate 1 to the support surface 14*a*, and installed to be horizontally or vertically movable. The workpiece holding and rotating means 14 is preferably, for example, a vacuum chuck apparatus or mechanical chuck apparatus.

The voltage applying means 16 comprises an electrode 16*a* oppositely aligned to the working surface 12*a* of the metal bond grinding wheel 12 in an uncontacted state, a power source (ELID power source 16*b*) for electrolytic dressing, a feeder 16*c* to feed the metal bond grinding wheel 12, and a feeding line 16*d* connecting them electrically, wherein the metal bond grinding wheel 12 is used as a positive electrode, an electrode 16*a* is used as a negative electrode, and a pulsed voltage is applied between both electrodes.

In addition, the grinding fluid feeding means 18 comprises a nozzle 18*a* for the grinding fluid, a feeding apparatus 18*b*, and a piping system 18*c* connecting and passing through them, and sends the electroconductive grinding fluid among the working surface 12*a* of the metal bond grinding wheel 12, namely, the working surface 12*a*, the electrode 16*a*, the support surface 14*a*, and the magnetic disc substrate 1. According to the aforementioned construction, the working surface 12*a* of the metal bond grinding wheel 12 is subjected to electrolytic dressing, and, simultaneously, grinding of the supporting surface 14*a*of the workpiece holding and rotating means 14 and grinding of the magnetic disc substrate 1 installed in the workpiece holding and rotating means 14 can be alternatively carried out on the machine.

Figure 2A:
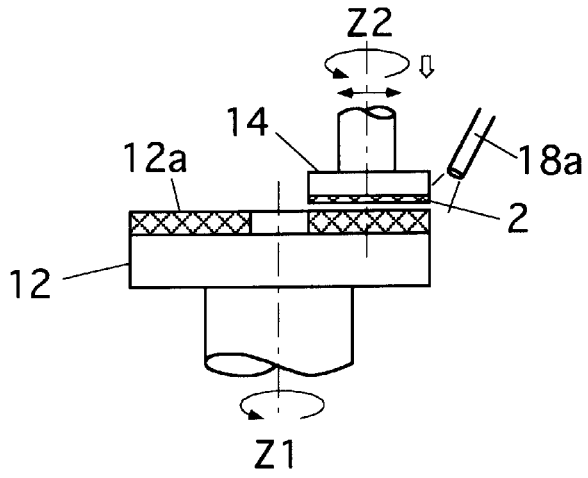
FIG. 2A is an illustrative view of a grinding wheel truing step.

FIGS. 2A to 2A are illustrative figures of the operation of the apparatus of FIG. 1, showing a method for mirror surface grinding of a magnetic disc substrate, according to the present invention.

The method of the present invention comprises a grinding wheel truing step (A), a supporting surface grinding step (B), and a workpiece grinding step (C).

In the grinding wheel truing step (A), the workpiece holding and rotating means 14 is horizontally moved and the working surface 12*a* of the metal bond grinding wheel 12 is subjected to horizontal flat grinding by using the truing grinding wheel 2 installed in the means 14 on the machine. The truing grinding wheel 2 comprises, preferably, diamond grains or CBN grains, and a binder.

According to this step, the horizontal and flat grinding of the working surface 12*a* of the metal bond grinding wheel can be performed on the machine, and, even if flatness precision of the working surface is lowered by abrasion, etc., not only the degree of flatness of the working surface of the grinding wheel, but also the degree of squareness of the working surface 12*a* grinding with respect to the rotation axis Z1 can be kept by on-machine truing.

In the supporting surface grinding step (B) and the workpiece grinding step (C), the metal bond grinding wheel 12 is used as a positive electrode, an electrode 16*a* oppositely aligned to the working surface 12*a* thereof in an uncontacted state is used as a negative electrode, and a pulsed voltage is applied between both electrodes using the power source 16*b*, and, simultaneously, the grinding fluid feeding means 18 sends the electroconductive grinding fluid between the electrodes to subject the metal bond grinding wheel 12 to electrolytic dressing. Electrolytic dressing permits greatly increasing the processing rate of the supporting surface and the magnetic disc substrate and making the surface coarseness of both surfaces of a high quality (mirror surface).

During electrolytic dressing, the supporting surface grinding step (B) grinds the supporting surface 14*a* of the workpiece holding and rotating means 14 by the metal bond grinding wheel 12, and the workpiece grinding step (C) grinds and processes the magnetic disc substrate 1 installed in the workpiece holding and rotating means 14 by using the metal bond grinding wheel 12. These steps (B) and (C) are alternatively carried out on the machine, if necessary.

According to this method, the supporting surface 14*a* of the workpiece holding and rotating means 14 is ground by horizontal moving and rotating the workpiece holding and rotating means 14 on the machine. The supporting surface grinding step (B) allows keeping the flatness of the supporting surface 14*a* and the degree of squareness with respect to the rotation axis Z2, and thus, keeping the degree of parallelism of the supporting surface 14*a* to the working surface 12*a* of the grinding wheel.

The reverse surface (bottom surface) of the magnetic disc substrate 1 is ground on the working surface 12*a* of the grinding wheel by horizontally moving, with rotation, the magnetic disc substrate 1 which closely contacts the supporting surface 14*a* of the workpiece holding and rotating means 14. Thus, the degree of parallelism (precision of thickness) of both surfaces of the magnetic disc substrate 1 can be always kept at a high precision by the workpiece grinding step (C).

Figure 3:
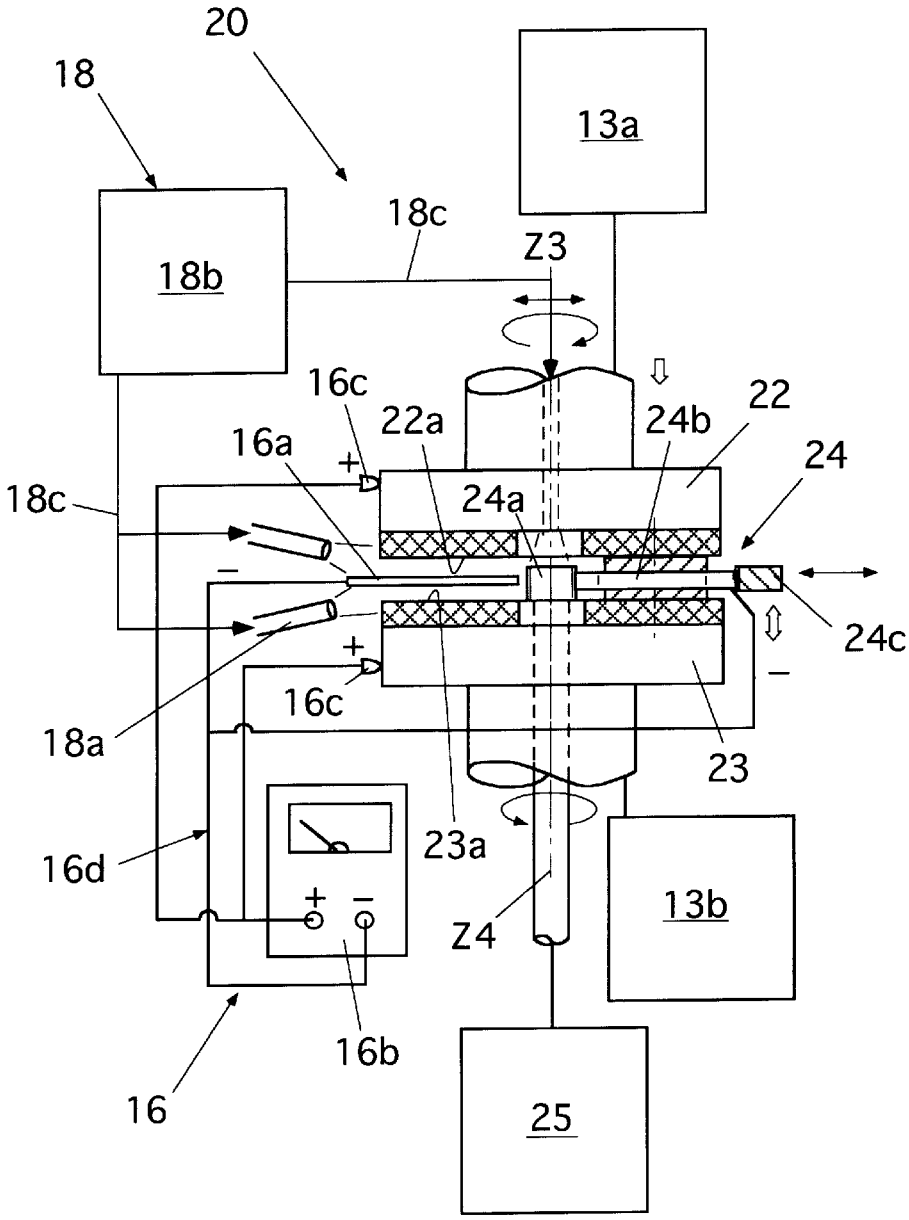
FIG. 3 is a general diagrammatic view showing the second embodiment for carrying out an apparatus for mirror surface grinding of a magnetic disc substrate, according to the present invention.

FIG. 3 is a total diagrammatic figure showing the second embodiment of an apparatus for mirror surface grinding of magnetic disc substrate, according to the present invention. In the figure, the apparatus 20 for mirror surface grinding, according to the present invention comprises a voltage applying means 16, a grinding fluid feeding means 18, upper and lower metal bond grinding wheels 22 and 23, and a workpiece holding and rotating means 24.

The upper and lower metal bond grinding wheels 22 and 23 have the upper and lower working surfaces 22*a* and 23*a* oppositely aligned to each other and are rotatively driven by the central vertical shafts Z3 and Z4 by independent actuators 13*a* and 13*b*. The central shafts Z3 and Z4 are installed in a highly precisely parallel position relative to each other. Either the upper or lower metal bond grinding wheel (e.g., 22) is horizontally or vertically movable in addition to rotatably driven. According to this structure, the upper and lower metal bond grinding wheels 22 and 23 are relatively and horizontally moved to closely contact each other, and in this manner, respective working surfaces 22*a* and 23*a* can be subjected to horizontal flat grinding on the machine. The workpiece holding and rotating means 24, in this example, comprises a sun gear 24*b* rotatively driven with the central axis Z4 of the under working surface 23 and independently by the actuator 25, a planetary gear 24*a* meshing with the sun gear 24*b*, and a ring gear 24*c* meshing with the outer periphery of the planetary gear 24*a*. The planetary gear 24*a* has a through hole, with which the magnetic disc substrate 1 is loosely engaged, in the position decentered from the center of rotation. The planetary gear 24*a* has been installed to be always located in a mid-position between the upper and lower metal bond grinding wheels 22 and 23.

According to this structure, rotating the sun gear 24*a* in a proper range of angle by the actuator 25 allows the magnetic disc substrate 1 to be held between the upper and lower metal bond grinding wheels 22 and 23 and horizontally shaken by rotating around the vertical shaft. This means that in this example, the sun gear 24*a* functions as a carrier to hold and shake the magnetic disc substrate 1. The carrier 24*a* is thicker than the electrode 16*a*.

The voltage applying means 16 has two feeders 16*c* and can apply a plus (+) voltage to the upper and lower metal bond grinding wheels 22 and 23, the feeding line 16*d* connected to the carrier 24*a* of the workpiece holding and rotating means 24, and can apply a minus (−) voltage to the carrier 24*a* simultaneously with applying to electrode 16*a* or by switching them. Other components are the same as those of the FIG. 1.

The grinding fluid feeding means 18 can provide a grinding fluid between grinding wheel 22 and 23 through a through hole opened in the center of the upper metal bond grinding wheel 22. Other components are the same as those of the FIG. 1.

Figure 2B:
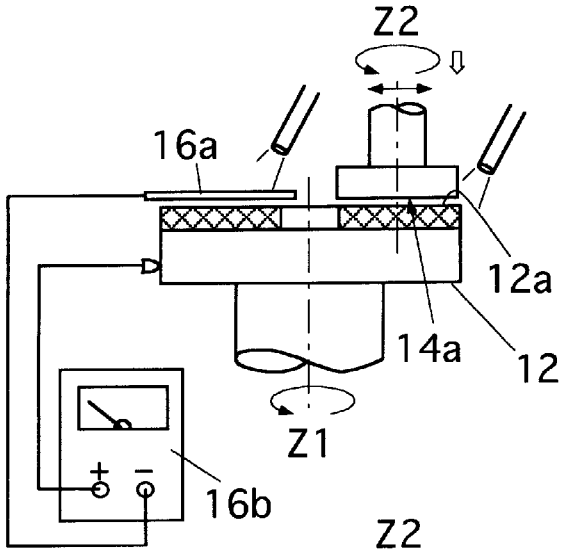
FIG. 2B is an illustrative view of a supporting surface grinding step.
Figure 2C:
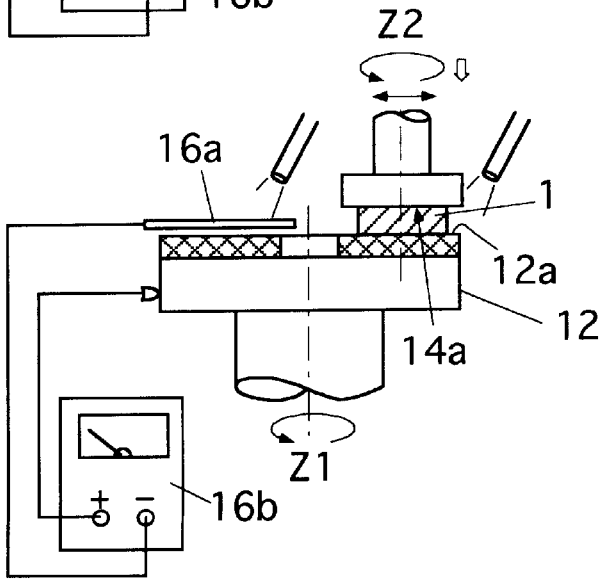
FIG. 2C is an illustrative view of a workpiece grinding step according to the present invention.
Figure 4A:
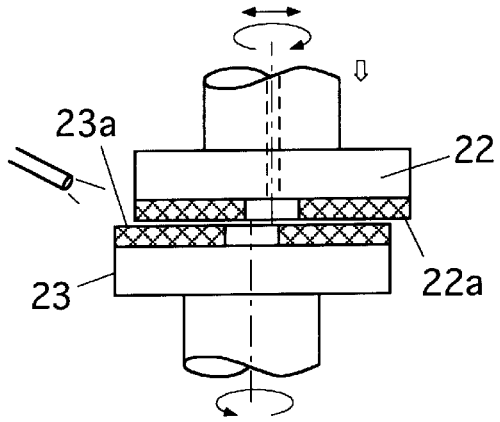
FIG. 4A is an illustrative view of a grinding wheel truing step.
Figure 4B:
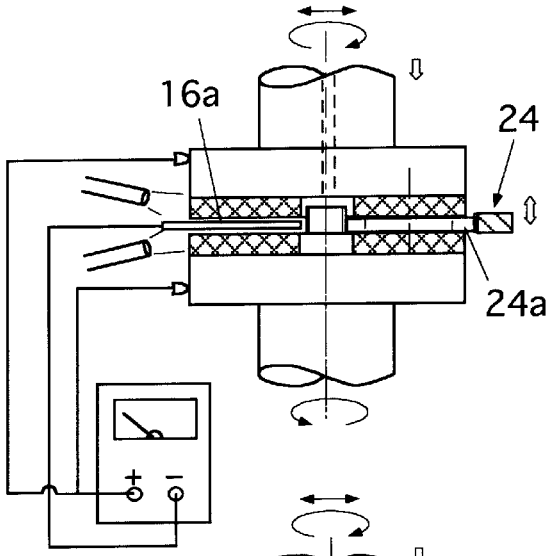
FIG. 4B is an illustrative view of a carrier grinding step.
Figure 4C:
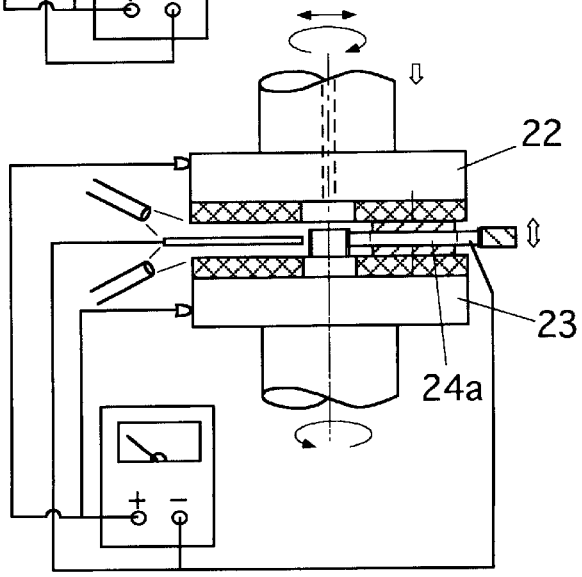
FIG. 4C is an illustrative view of a workpiece grinding step according to the present invention.

FIGS. 4A to 4B are illustrative figures of the operation of FIG. 2, showing a method for mirror surface grinding of magnetic disc substrate, according to the present invention. The method of the present invention comprises a grinding wheel truing step (A), a carrier grinding step (B), and a workpiece grinding step (C).

The grinding wheel truing step (A) moves relatively horizontally the upper and lower metal bond grinding wheels 22 and 23 to contact closely each other, and by this, subjects respective working surfaces 22*a* and 23*a* to horizontal flat grinding on the machine. According to this step, even if flatness precision of the working surface is lowered by abrasion, etc., not only the degree of flatness of the working surface of the grinding wheel, but also the degree of squareness with respect to the rotational axis can be kept by on-machine truing finally resulting in keeping the degree of parallelism of the upper and lower working surfaces 22*a* and 23*a* with high precision.

Subsequently, the carrier grinding step (B) and the workpiece grinding step (C) are optionally alternatively operated on the machine.

In the carrier grinding step (B), the upper and lower metal bond grinding wheels are used as positive electrodes, the electrode 16*a* is used as a negative electrode, and a pulsed voltage is applied between both electrodes, and, simultaneously, the electroconductive grinding fluid is sent between them to subject the upper and lower metal bond grinding wheels to electrolytic dressing, further simultaneously, both the surfaces of the carrier 24*a* of the workpiece holding and rotating means 24 held between the upper and lower metal bond grinding wheels are simultaneously ground on the machine by the upper and lower metal bond grinding wheels. According to these steps, the degree of parallelism of both the surfaces of the carrier 24*a* (precision of thickness) can be kept with high precision and their surface coarseness can be kept to a mirror surface quality beyond that of conventional levels.

In the workpiece grinding step (C), the carrier 24*a* is used as a negative electrodes to subject the upper and lower working surfaces 22 and 23 to electrolytic dressing, and, simultaneously, both surfaces of the magnetic disc substrate 1, held between the upper and lower working surfaces 22 and 23, are simultaneously ground and processed on the machine. According to this step, electrolytic distribution between the carrier 24*a* and the metal bond grinding wheels 22 and 23 can be made with high precision. Thus, both the surfaces of the magnetic disc substrate 1 are ground and processed evenly with high precision while using electrolytic dressing to make possible a high degree of parallelism (precision of thickness) with high precision and make possible a surface coarseness corresponding to a mirror surface much improved over the conventional methods.

In the aforementioned embodiment for carrying out the present invention, the grinding of the magnetic disc substrate as an example of a workpiece is described in detail. However, the aforementioned embodiment is to be considered in all respects as illustrative and not restrictive, and applicable to a member requiring a degree of parallelism of both surfaces (precision of thickness) as well.

As stated above, the apparatus and the method for mirror surface grinding of the magnetic disc substrate according to the present invention has excellent effects such as a large increase in the processing rate of the magnetic disc substrate in comparison with the conventional lapping machine and a more improved degree of parallelism (precision of thickness) of both surfaces and more improved surface coarseness than the conventional methods.

Although the preferred embodiment of the claimed invention has been described, this embodiment is to be considered in all respects as illustrative and not restrictive. In other words, the extent of the present invention includes all improvements, amendments, and equivalents included in the range of the claims attached hereto.

What is claimed is:

1. An apparatus for the mirror surface grinding of a magnetic disc substrate, comprising:

a first upper positive electrode metal bond grinding wheel having a horizontal working surface and being rotatable with a first central vertical shaft;

a second lower positive electrode metal bond grinding wheel having a horizontal working surface opposed to the working surface of the first grinding wheel, and being rotatable with a second central vertical shaft;

a workpiece holder and rotator adapted to hold a magnetic disc substrate to rotate around a vertical axis between first portions of the working surfaces of the upper and lower grinding wheels and shake the magnetic disc substrate in a horizontal direction, said holder and rotator comprising a carrier constructed to carry the magnetic disc substrate, and arranged to be optionally ground by said upper and lower grinding wheels;

a negative electrode opposed to second portions of the working surfaces of the metal bond grinding wheels and not in contact therewith, wherein the negative electrode is arranged to allow simultaneous grinding of a work piece and electrolytic dressing of the grinding wheels;

a voltage supply arranged to apply a pulsed voltage between the negative electrode and the positive electrode metal bond grinding wheels;

a grinding fluid supply arranged to supply grinding fluid between the negative electrode and the grinding wheel to permit electrolytic dressing of the grinding wheel, when the pulsed voltage is applied between the grinding wheel and the negative electrode.

2. An apparatus for the mirror surface grinding of a magnetic disc substrate according to claim 1, wherein said workpiece holder and rotator holds an outer periphery of a magnetic disc substrate to rotate the substrate.

3. An apparatus for the mirror surface grinding of a magnetic disc substrate according to claim 1, wherein said grinding wheel comprises cerium oxide grains or CBN grains and a binder including cast iron and cobalt.

4. A method for grinding of a magnetic disc substrate using upper and lower metal bond grinding wheels having mutually opposing working surfaces, rotatable about first and second vertical central shafts, a workpiece holder and rotater for holding a workpiece between the upper and lower metal bond grinding wheels and horizontally shaking the substrate while rotating the substrate about a vertical axis, the method comprising the steps of:

(a) subjecting the upper and lower metal bond grinding wheels to horizontal flat grinding by mutually contacting the wheels and relatively horizontally moving the wheels, (b) after step (a), applying a pulsed voltage between the upper and lower metal bond grinding wheels as positive electrodes and a negative electrode disposed opposite from and not in contact with the working surfaces of the upper and lower metal bond grinding wheels, and simultaneously feeding an electro-conductive grinding fluid between the upper and lower metal bond grinding wheels and the electrode, and subjecting the metal bond grinding wheel to electrolytic dressing; and (c) alternatively carrying out, simultaneously with step (b), (1) simultaneously grinding both surfaces of a carrier of the workpiece holder and rotator with the working surfaces of the upper and lower metal bond grinding wheels, or (2) simultaneously grinding both surfaces of a magnetic disc substrate held in the workpiece holder and rotator with the working surfaces of the upper and lower metal bond grinding wheels.

* * * * *